United States Patent [19]

Volinskie

[11] 4,085,994

[45] Apr. 25, 1978

[54] DUAL SLOT CONTACT

[75] Inventor: Robert Volinskie, Hershey, Pa.

[73] Assignee: AMP, Incorporated, Harrisburg, Pa.

[21] Appl. No.: 713,724

[22] Filed: Aug. 12, 1976

[51] Int. Cl.[2] ..... H01R 9/08

[52] U.S. Cl. ..... 339/95 R; 200/238; 339/97 R

[58] Field of Search ..... 339/95, 97 R, 97 P, 339/98 R, 99 R, 258; 200/175-178, 237, 238

[56] References Cited

U.S. PATENT DOCUMENTS

| | | | |
|---|---|---|---|
| 3,145,261 | 8/1964 | Forney, Jr. | 339/98 X |
| 3,605,072 | 9/1971 | Driscoll | 339/98 |
| 3,611,263 | 10/1971 | Krone et al. | 339/97 R |
| 3,878,318 | 4/1975 | Zeegler, Jr. et al. | 339/97 R |
| 3,950,062 | 4/1976 | Reaves, Jr. | 339/97 R |
| 3,980,379 | 9/1976 | Bone | 339/98 |

*Primary Examiner*—Harold Tudor
*Attorney, Agent, or Firm*—D. W. Phillion

[57] ABSTRACT

A slotted plate type contact is disclosed for simultaneously terminating two wires of small diameter which are inserted simultaneously in a first slot portion of the contact and are automatically diverted into separate wire terminating slots.

2 Claims, 1 Drawing Figure

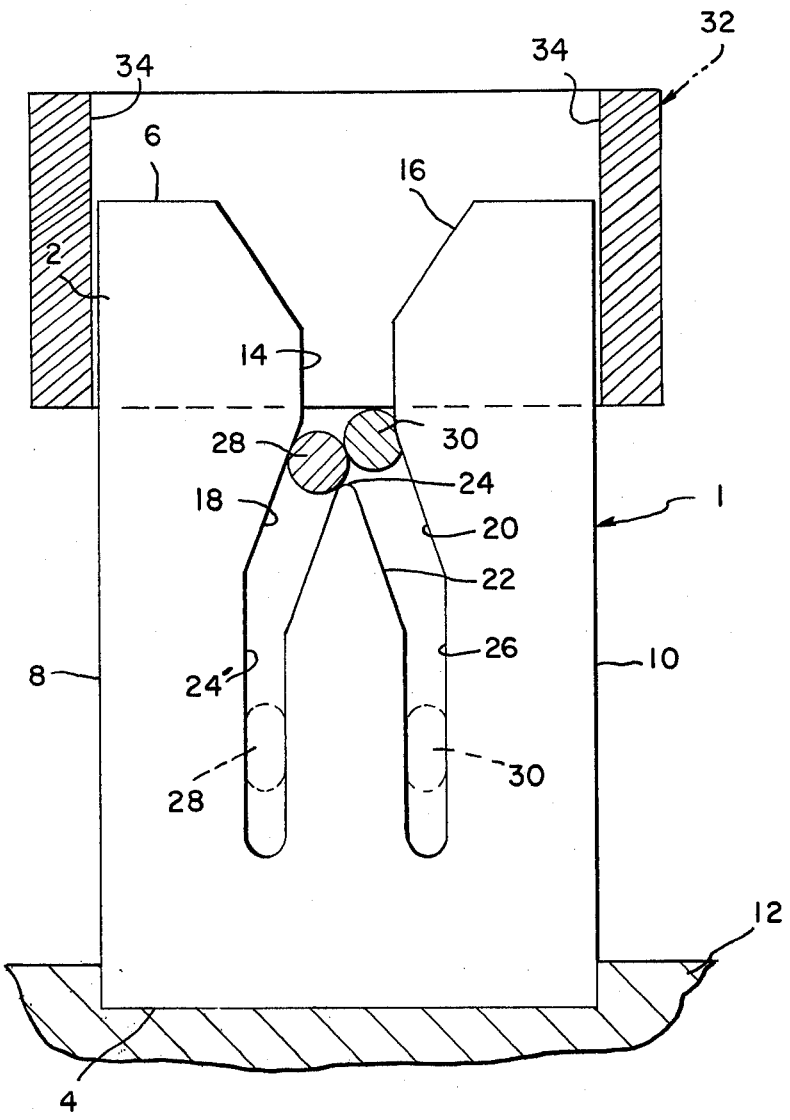
32
34
34
6
16
2
14
28
30
24
18
1
20
22
26
8
10
24
28
30
12
4

DUAL SLOT CONTACT

FIELD OF THE INVENTION

The present invention relates to a slotted plate type electrical contact useful for electrically connecting a pair of wires, and more particularly, to a contact having a wire receiving slot which is bifrucated into a pair of wire terminating slot portions separated by a diverter which separates a pair of small diameter wires automatically into corresponding wire terminating slot portions.

BACKGROUND OF THE PRIOR ART

Previous attempts to terminate one or more small diameter wires in the same slotted plate contact was accomplished by forcing the wires into the same slot, or by separately inserting each wire into a corresponding separate slot. By the first terminating procedure uneven gripping forces are developed on one or more wires in the same slot. According to the second terminating procedure many sequential operations are required to lace individual wires into corresponding slots.

BRIEF DESCRIPTION

In the present invention a pair of wires are simultaneously laced into a single slot of a slotted plate type contact. A ram type insertion tool then forces the wires down the slot until the wires engage a diverter which diverts the wires to either side thereof. Further insertion forces the wires into corresponding wire terminating slot portions which intersect the wire receiving slot portion. Small diameter wires of different gauges may be terminated in the contact according to the present invention. The wire receiving slot portion must be of a width greater than any one of the wires to be terminated but less than the combined diameters of a pair of wires to be terminated. In effect each wire terminating slot portion must possess a width less than the diameter of a wire to be terminated therein. The entryway for each of the wire terminating slots are located on either side of a diverter portion of the contact and must be of less width than the diameter of a wire to be received therein.

OBJECTS

Accordingly an object of the present invention is to provide a slotted plate type electrical contact useful for simultaneously receiving and terminating a pair of small diameter wires.

Another object of the present invention is to provide a slotted plate type contact having a wire receiving slot portion which is bifurcated into a pair of wire terminating slot portions on either side of a diverter portion of the contact such that a pair of wires inserted into and along the wire receiving slot are separated on either side of the diverter and are forcefully inserted into corresponding wire terminating slot portions.

Another object of the present invention is to provide a slotted plate type electrical contact having a wire receiving slot portion which divides into a pair of wire terminating slot portions on either side of a diverter portion of the contact whereby a pair of wires of unequal diameters inserted into the wire receiving slot portion are diverted on either side of the diverter for forcible insertion and termination into the wire terminating slot portions.

Other objects and many attendant advantages of the present invention will become apparent from the detailed description and the accompanying drawings.

DESCRIPTION OF THE DRAWINGS

The FIGURE is an enlarged elevation of a slotted plate type contact according to the present invention.

DETAILED DESCRIPTION

With more particular reference to the drawing there is illustrated generally at 1 a slotted plate type electrical contact 2 fabricated from stiffly resilient metal spring material and having a bottom margin 4, a top margin 6 and side margins 8 and 10. The bottom margin 4 is adapted to be fixed in a base 12 which may be either a rigid conductive material or a rigid dielectric material as desired. The top margin 6 is provided with a generally vertical wire receiving slot portion 14 communicating with the edge margin 6 and provided with a flared entryway 16 also communicating with the edge margin 6. The wire receiving slot portion 14 is bifurcated and separates or divides into a pair of diverging slot portions 18 and 20. The diverging slot portions 18 and 20 diverge at corresponding acute angles of 20° with respect to the longitudinal vertical axis of the wire receiving slot portion 14. A frusto-conical portion 22 of the slotted plate contact is between the diverging slot portions 18 and 20. The apex 24 of the portion 22 is rounded as shown. The diverging slot portions 18 and 20 further are contiguous with wire terminating slot portions 24' and 26 which are parallel to the longitudinal vertical axis of the slot portion 14.

The slot portion 14 is of a width greater than the diameter of any one wire to be terminated in the contact 1 but less than the combined diameters of a pair of wires to be terminated therein. The width of each divergent slot portion 18 or 20 has a width, particularly at the entryway thereof, less than the diameter of any one of a pair of wires to be terminated to the contact 1. The entryway of each slot portion 18 or 20 is adjacent the apex 24 and is also at the intersection of the corresponding slot portion 18 or 20 with the slot portion 14.

Each of the wire terminating slot portions 24' and 26 is of a width substantially less than the width of any one of the wires to be terminated in the contact 1.

In operation a pair of small gauge diameter uninsulated wires 28 and 30 are simultaneously inserted into the entryway 16 and are urged by a ram 32 deeply slotted at 34 along the wire receiving slot portion 14. Because of the restricted width of the slot portion 14 the wires 28 and 30 must be horizontally offset as they are being inserted along the slot portion 14. Ideally the wires 28 and 30 are also vertically offset as shown in the drawing figure. However, even if they are in vertical alignment as they are inserted along the slot portion 14 the foremost or leading wire 28 will engage the apex 24 of the diverter and be diverted to either side thereof. As shown the foremost wire 28 is diverted to the left of the diverter portion 22 substantially offsetting the wire 28 from the vertical central axis of the slot portion 14. The wire 28 further is diverted into the entryway of the slot portion 18. The deeply slotted ram type tool 32 receives the contact 1 in the slot 34 and is forcefully urged vertically downward along the contact 1 in a direction parallel to the longitudinal axis of the slot portion 14 is forcibly urge the wires 28 and 30 into the wire terminating slot 24' and 26. More particularly, with the wire 28 at the entryway of the slot portion 18 considerable force is needed to impel the wire 28 along the slot portion 18, since the slot portion 18 is at an angle to the vertical axis of ram motion and since the width of the slot portion 18 is less than the diameter of the wire 28. Thus while insertion of the pair of wires 28 and 30 vertically along the slot portion 14 is readily accomplished by the ram, when a foremost one of the wires is diverted by the diverting portion 22 into an entryway of one of the slots 18 and 20, considerable resistance to further insertion of the diverted wire occurs. Due to such resistance the foremost wire 28 thereby is momentarily detained at the corresponding entryway. The following or trailing wire 30 thus engages the momentarily detained wire 28 and is diverted by the detained wire 28 toward the other side of the diverter 22 and toward the entryway of the other slot portion 20. Subsequently, additional vertical downward pressure of the ram 32 overcomes the resistance to insertion of the wire 28 such that the wire 28 is forcibly urged along the slot portion 18. The wire 30 also is forcibly urged along the slot portion 20. Further continued downward pressure of the ram 32 forcibly inserts the wires 28 and 30 into the wire terminating slot portions 24' and 26 where they are substantially ovalled, as shown in phantom outline, by the gripping pressure applied thereon.

To verify operation of the contact several tests were performed.

TEST 1

A pair of 28 gauge uninsulated, tin plated copper wires were placed simultaneously in the flared entryway. A deeply slotted ram then was vertically downwardly urged over the slotted plate contact longitudinally of the wire receiving slot portion 14 of the contact, forcing the wires downwardly into corresponding divergent slot portions 18 and 20 of the contact. The ram was removed from the contact. It was observed that the two wires indeed separated of their own accord into corresponding diverging slot portions 18 and 20.

TEST 2

A pair of 30 gauge wires were subjected to the procedures of Test 1. In only some cases both 30 gauge wires were inserted undesirably into the same slot portion either 18 or 20 rather than into corresponding diverging slot portions 18 or 20.

TEST 3

A pair of 28 gauge wires were twisted together and subjected to the procedures of Test 1. The wires were loosely twisted to permit insertion of portions of their lengths into corresponding diverging slot portions without a need for untwisting the wires. The wires indeed were successfully inserted into corresponding slots following the procedure of Test 1.

TEST 4

A pair of 30 gauge wires were twisted together as in Test 3. By repeating the procedure of Test b 1, the wires were inserted undesirably into the same slot, at an occurrence rate more often than observed in Test 2.

TEST 5

Each of the Tests 1–4 were repeated using a pair of wires, one wire of 28 gauge and a second wire of 30 gauge. The different gauge wires were successfully inserted into corresponding slots following the procedures of Tests 1 and 3, if the 28 gauge wire was the foremost wire to be inserted. Unsuccessful results were observed if the 30 gauge wire was the foremost wire. Unsuccessful results were observed also following the procedures of Tests 2 and 4.

Several observations and conclusions could be drawn from the above tests. The first observation was that the smaller gauge wire provided unsuccessful results whereas the larger gauge wire provided successful results. Accordingly the entryway of each divergent slot portion should be sufficiently narrow in width to resist insertion of the foremost wire until further motion of the ram forces the trailing wire to be diverted by the first wire. The entryway of each diverging slot portion also must have a maximum allowable width to correspond with the diameter of wire to be terminated. Further the entryway of each divergent slot portion should be sized according to the smallest diameter wire of a pair of wires to be terminated. Also the divergent slot portions should be sufficiently divergent from the direction of ram motion to increase the resistance to forcible insertion of the foremost wire until the ram urges the trailing wire past the first wire and either into the entryway of the remaining divergent slot portion or at least on the other side of the apex 24.

Although a preferred embodiment of the present invention is shown and described other modifications and embodiments thereof which would be apparent to one having ordinary skill in the art are intended to be covered by the spirit and scope of the appended claims.

What is claimed is:

1. A slotted plate electrical contact, comprising:

a single metal plate having a slot therein, said slot including an initial slot portion and first and second diverging slot portions each having an entryway communicating with said first slot portion, a portion of said plate having an apex between said diverging first and second slot portions, said initial slot portion having a width greater than the diameter of a first or a second uninsulated, relatively small diameter wire to be connected electrically in said slot but less than the sum of diameters of said first and second wires, said first and second diverging slot portions each having a width less than the diameter of a first or a second wire to be connected electrically in said slot, and a length greater than the diameter of a first or a second wire to be electrically connected in said slot, said apex being so constructed and arranged for diverting a first wire to either side thereof into one said entryway of one of said diverging slot portions, whereby a first wire is detained in one said entryway, and a second wire is diverted by a first wire detained in one said entryway into an entryway of the remaining diverging slot portion, whereby a first and a second wire are positioned respectively in said entryways for corresponding wire termination in said diverging slot portions.

2. The structure as recited in claim 1, and further including: each of said first and second diverging slot portions having narrow width slot portions elongated parallel to said initial slot portion and forming wire terminating slot portions.

* * * * *